United States Patent [19]

Willis

[11] 4,324,005

[45] Apr. 13, 1982

[54] PROTECTIVE HEADGEAR

[75] Inventor: Betty A. Willis, Maple Valley, Wash.

[73] Assignee: Charles S. Willis, Maple Valley, Wash. ; a part interest

[21] Appl. No.: 113,349

[22] Filed: Jan. 18, 1980

[51] Int. Cl.[3] ..... A42B 3/02

[52] U.S. Cl. ..... 2/413; 2/DIG. 10

[58] Field of Search ..... 2/DIG. 10, 413, 424

[56] References Cited

U.S. PATENT DOCUMENTS

| | | | |
|---|---|---|---|
| 606,982 | 7/1898 | Smyth | 2/DIG. 10 |
| 780,899 | 1/1905 | Mogridge | 2/413 |
| 882,686 | 3/1908 | Ireland | 2/413 |
| 1,256,594 | 2/1918 | Rodal | 2/2 |
| 2,121,702 | 6/1938 | Larkin | 2/413 |
| 2,150,290 | 3/1939 | Mulvey | 2/425 |
| 3,254,883 | 6/1966 | Morgan | 267/1 |
| 3,462,763 | 8/1969 | Schneider et al. | 2/425 |
| 3,668,704 | 6/1972 | Conroy | 2/425 |
| 3,866,243 | 2/1975 | Morgan | 2/417 |
| 3,872,511 | 3/1975 | Nichols | 2/413 |
| 3,911,914 | 10/1975 | Johansson | 2/424 |
| 4,014,048 | 3/1977 | Rappleyea | 2/413 |
| 4,035,846 | 7/1977 | Jencks | 2/413 |
| 4,134,156 | 1/1979 | Gyory | 2/413 |

FOREIGN PATENT DOCUMENTS

| | | | |
|---|---|---|---|
| 1203481 | 1/1960 | France | 2/413 |

*Primary Examiner*—Louis Rimrodt

*Attorney, Agent, or Firm*—Klarquist, Sparkman, Campbell, Leigh, Whinston and Dellett

[57] ABSTRACT

A collapsible headpiece is worn to provide protection from impacts to the head during an emergency situation. Multiple inflatable flaps, mounted on a skullcap, are connected with a gas supply apparatus mounted on the headpiece.

1 Claim, 6 Drawing Figures

PROTECTIVE HEADGEAR

BACKGROUND OF THE INVENTION

The present invention relates to protective headgear to be worn by the passengers of a moving vehicle to protect against injury to the head. More specifically, it relates to protective headgear for use by the passengers of commercial aircraft during an emergency landing.

There presently exists an extensive variety of protective helmets to be used by persons riding in vehicles or engaged in athletic events to provide protection against impacts to the head of the wearer. Typically, these structures include a rigid or semi-rigid outer shell of metal or hard plastic and a liner of cushioning material interposed between the head and the shell.

The shell acts to prevent penetrations and to distribute the force of a blow directed at any one position. The liner acts to absorb part of the energy from the blow to reduce the amount of force transmitted to the head.

In some of these helmets, the cushioning material comprises an inflatable member mounted inside the rigid helmet shell. For example, U.S. Pat. No. 3,668,704 (Conroy et al.) shows an inflatable helmet liner used for cushioning purposes.

Such hard shell helmets may be suitable for use when numerous impacts are expected, such as when playing American football, or when the risk of accident is relatively high, as when riding a motorcycle. But, hard shell helmets have many disadvantages.

Most specifically, hard shell helmets are expensive and uncomfortable. They are bulky, heavy and difficult to store. For the foregoing reasons, such protective headgear is not used in many circumstances where head protection would be beneficial.

For example, the passengers and crew of nonmilitary aircraft do not typically wear protective headgear. This leaves the passengers vulnerable to head injury, particularly when a plane is forced to make an emergency landing under adverse conditions.

Vulnerability is particularly acute for certain passengers. Small children, for example, frequently ride on the laps of adult passengers. Because such children are not secured by seat belt restraints, they may be thrown about the airplane cabin during a sudden deceleration.

Even if wearing seatbelts, some juvenile and elderly passengers are unable to assume the head-between-legs emergency position recommended during emergency landings. Such a passenger is particularly susceptible to having his upper body thrown forward so that his head strikes the immediately forward seat back or bulkhead.

The frequency of emergency landings is low, so it is not reasonable to expect passengers of commercial airlines to wear helmets during flight. Nor is there justification for devoting storage space in an aircraft cabin for the number of bulky hard shell helmets needed to supply all passengers during an emergency landing. As a result, passengers are not provided with protective headgear, even during emergency landings.

Previously it has been unknown to construct protective headgear without a hard shell member. Possibly this is because suitable structures have not been devised for soft headpieces or because it was felt that a soft headpiece could provide little penetration protection.

SUMMARY OF THE INVENTION

Many of the difficulties of the prior art helmets are completely obviated by use of collapsible headpieces according to the present invention.

A turban-like headpiece is constructed of flexible, resilient material so that it can be folded and/or collasped to occupy a small volume for storage when not in use.

When the need arises, e.g. when a commercial aircraft is forced to make an emergency landing with advance warning, the collapsed headpieces may be removed from storage and distributed to passengers. The headpieces can then be unfolded, expanded and/or inflated to provide each passenger a self-supporting protective headpiece to be worn during the emergency landing.

The most advantageous embodiments include multiple cushioning members positioned to provide coverage for substantially all of the head except, possibly, the facial region. A hard shell is not needed to protect against penetrations since all hard movable objects in an aircraft cabin are stowed in closed compartments or beneath seats during an emergency landing procedure.

The best protection is achieved with embodiments which include multiple gas-filled cushioning members which surround the head to distribute the force of impacts. The members are interconnected by narrow passageways so that gas flow between compartments is impeded to prevent compartment collapse should the full force of an impact be received by only one cushioning member.

It is, accordingly, an object to provide protective headgear for use in commercial aircraft.

To provide suitable headgear, it is an object to make a collapsible headpiece which can be folded to occupy a minimum of volume for easy storage and which may be expanded to provide protection for substantially the entire head of the person wearing the headpiece.

An additional object is to provide a headpiece which can substantially cushion impacts between the head and a fixed object.

Another object is to provide an apparatus which is made of sufficiently inexpensive material and with a sufficiently simple design that the headpiece can be mass produced for general use in aviation.

A further object is to provide an effective headpiece which is self-supporting when worn and does not require a rigid, external shell.

To accomplish such goals it is a specific object to provide a headpiece which is inflatable and includes a self-contained source of inflating gasses.

A related specific object is to provide a backup means for orally or manually inflating the headpiece should the automatic inflation mechanism fail.

These and other objects and features of the present invention will be apparent from the drawing and description of a preferred embodiment.

DESCRIPTION OF A PREFERRED EMBODIMENT

Figure 2:
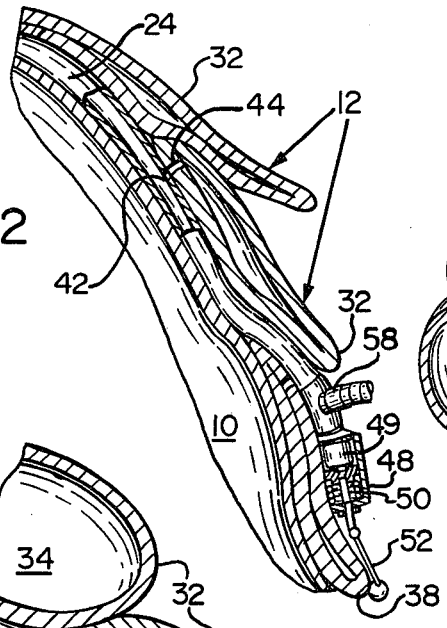
FIG. 2 is a partial sectional view of the headpiece prior to inflation.
Figure 1:
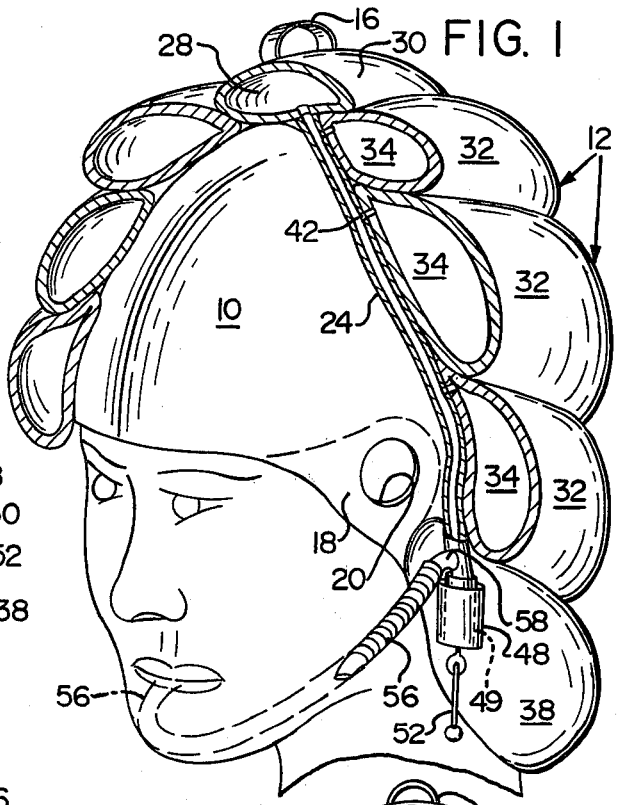
FIG. 1 is a perspective view, with portions cut away, of a partially inflated protective headpiece being worn by a user.
Figure 3:
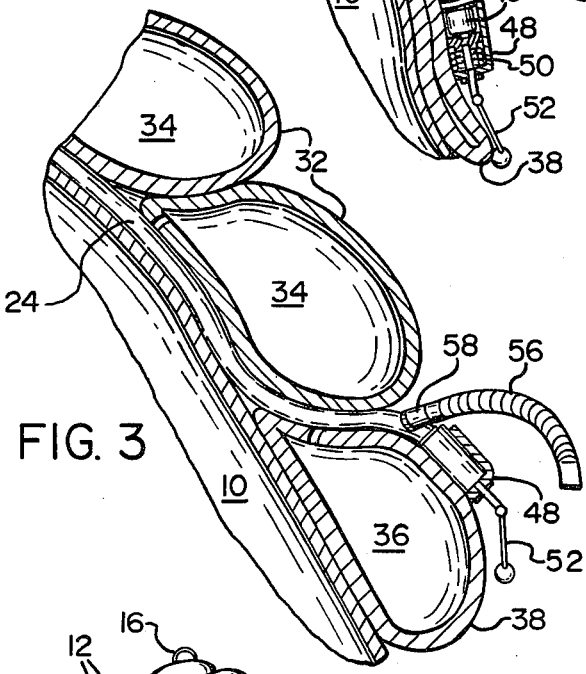
FIG. 3 is a partial sectional view of the headpiece after full inflation.

The protective headpiece of the present invention is best understood with reference to the drawing, FIGS. 1-3 illustrating the internal structure of a preferred embodiment.

In the illustrated embodiment, a protective shell for the head is created by a skullcap member 10 which serves as a support for a plurality of inflatable flaps 12. As best shown in FIG. 2, the flaps lay substantially flat against the skullcap member 10 when deflated. Both the skull cap and the flaps are made of a flexible resilient material so that the entire headpiece can be folded to occupy a small volume during storage. The flaps are permanently bonded to the skullcap member 10.

The skullcap is shaped and sized to snugly fit the head of a wearer. It is made of a material, such as synthetic rubber or a thermoplastic material, which is expandable so that the skullcap 10 will fit the head of the wearer snugly. Such a skullcap may be pulled on in the manner of a bathing cap and will remain in place, without the aid of chin straps or other mechanical fastenings, until pulled off by the wearer. To facilitate removal of the skullcap 10, a handle 16 is located at or near the top of the headpiece so the wearer can grip the handle 16 to pull off the headpiece after use.

The skullcap and supported flaps 12 are shaped to cover substantially the entire head to provide protection for all areas of the skull except the immediate facial region. The cap 10 may include an open segment 18 around each ear. The segments 18 are free of flaps so that an opening 20 may be provided through the skullcap 10 at the location of the wearer's ears. This construction allows the skullcap to retain a good elastic grip on the head without impairing the wearer's senses of hearing or sight.

The flaps 12 are hollow and thereby define a plurality of compartments to receive an inflating fluid such as air or $CO_2$ gas. As best seen in FIG. 1, the compartments are linked by a fluid delivery duct, such as gas delivery tube 24, which extends generally vertically from the uppermost flap to the lowermost flap. The compartments together thus define a fluidtight chamber which can be inflated by delivering pressurized fluid through the delivery tube 24.

The flaps are arranged to provide maximum protection for the head when inflated. An uppermost, discus-shaped compartment 28 is formed by a flap 30 at the top of the headpiece. This compartment 28 is located over the crown of the wearer's head to protect against downward or other blows to the crown.

Figure 4:
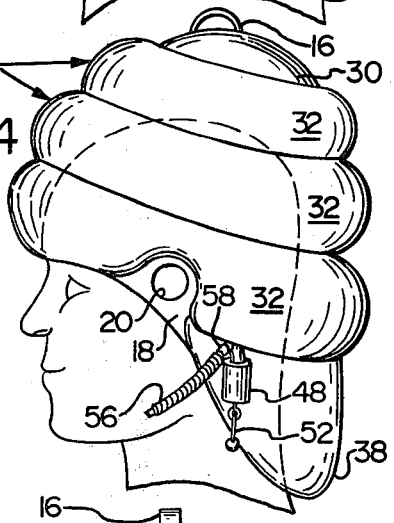
FIG. 4 is a side elevational view of a fully inflated headpiece being worn by the user.
Figure 6:
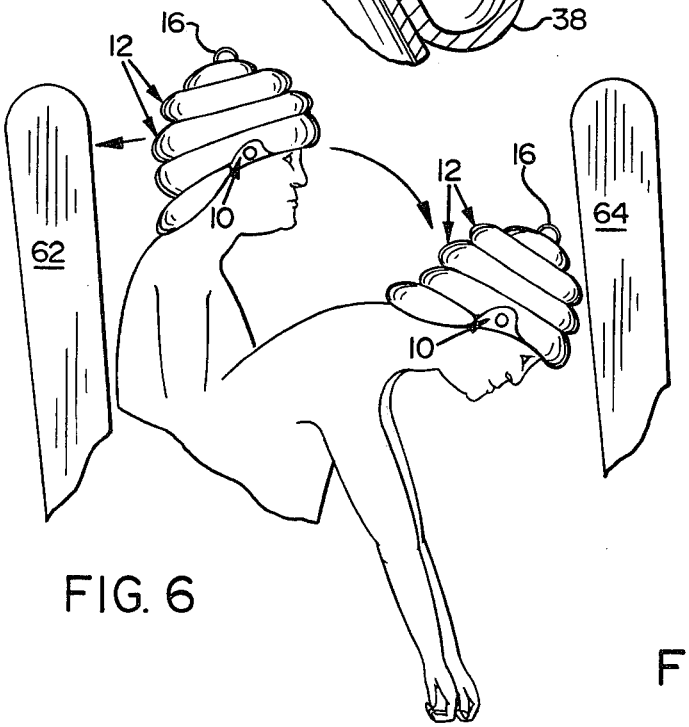
FIG. 6 is a schematic elevational view of a seated person wearing a headpiece during rapid deceleration.
Figure 5:
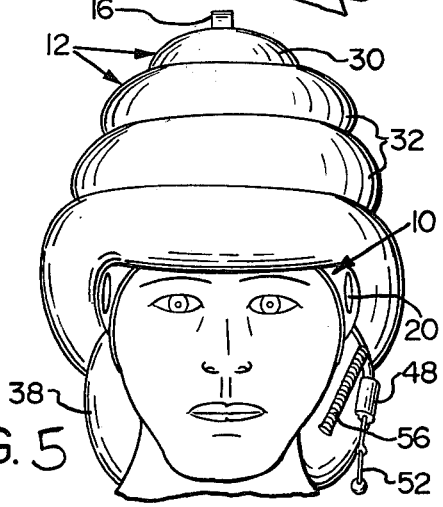
FIG. 5 is a front elevational view of the headpiece shown in FIG. 4.

A plurality of flaps 32 comprise toroidal tubes which extend substantially horizontally around the wearer's head at about forehead level. These flaps 32 define compartments 34 which are positioned to protect against blows to the forehead, back and sides of the head. The tubes may be positioned to rise somewhat toward the wearer's face as shown in FIG. 4, so the back of the head will be fully protected, but vision unimpaired.

A lowermost compartment 36 is defined by flap 38 which is positioned to be located behind the wearer's neck. Generally speaking this flap may comprise a curved tube with closed ends. It may extend substantially downwardly, as shown in FIG. 4, to provide full protection and support for the neck.

As previously described, the gas delivery tube 24 joins each of the compartments 28, 34, 36. This tube 24 is bonded to each of the flaps such that a radial bore 42 through the tube aligns with a bore 44 through each of the flaps as shown most clearly in FIG. 2. One way valves (not shown) can be connected to the bores 44 to prevent the individual flaps from deflating.

Tube 24 also connects to a source of pressurized fluid such as the gas canister 48 located on the outside surface of the flap 38. The canister 48 includes a cyliner 49 of pressurized gas, such as carbon dioxide, and a spring loaded mechanism 50 for puncturing the cylinder to release gasses into the tube 24 when a ripcord 52 is pulled.

As shown in FIGS. 1 and 3, a flexible, expansible blow tube 56 is provided as an alternate mechanism for filling the compartments. The tube 56 connects to the delivery tube 24 and includes a mouth piece at its free end. The flaps 12 may be inflated by blowing through the mouth piece of the tube 56 as illustrated by broken lines in FIG. 1.

A one-way valve 58 is provided in the tube 56 so that gas can flow only in a direction toward the tube 24. The valve 58 thus prevents the flaps from deflating.

OPERATION

Headgear according to this invention would primarily be used only under emergency or unusual circumstances, although it could have application in some semi-contact athletic activities, or for other purposes. The operation of the apparatus would be the same in any event, but the procedure practiced by the wearer would be somewhat different.

If, for example, the apparatus of the present invention were being used as a protective headpiece for passengers of a commercial airline, the headpieces would normally be stowed in a completely collapsed or deflated condition. The headgear would not be used during a normal flight.

If it is learned in advance that an emergency landing under adverse conditions is required, headpieces according to the invention are distributed to passengers and crew of the flight. These persons are instructed to pull the skullcap member 10 over their head so that it fits snugly and does not obstruct vision. Once the cap is in place, the wearers are instructed to pull the ripcord 52 which will release the spring loaded mechanism 50 so that a pin is forced into the gas cylinder 49 thereby releasing a stream of pressurized gas inside the canister 48. The gas will flow from the canister into the tube 24 and from there into the compartments 28, 34, 36. The amount of gas in the cylinder 50 will be established in advance to exactly fill the chambers to the proper inflation.

If, upon pulling the ripcord 52, the mechanism 50 fails to puncture the cylinder 49, or if the cylinder 59 contains an insufficient amount of gas to fully inflate the flaps 12, a wearer can use the blow tube 56 to complete inflation of the flaps 12. The one-way valve 58 allows air to flow into the tube 24, but prevents any gas previously released from the cylinder 49 or blown into the tube 24 from escaping back through the tube 56.

Once his headpiece is inflated, a passenger follows the normal emergency landing procedures, either placing his head between his legs or maintaining his head in an upright position in front of the back member 62 of the seat in which he is sitting. If the plane is tossed about or stops abruptly upon landing, the passenger's upper body will be thrown about and/or accelerated forward into the back 64 of a seat in front of the passenger. The passenger's head may also rebound into the seat back 62. In either event, the protective headpiece will cushion the wearer's head from contact with the seat structures.

While I have shown and described a preferred embodiment of my invention, it will be apparent to those skilled in the art that changes and modifications may be made without departing from my invention in its broader aspects.

For example, it would be possible to create inflatable headgear surrounding substantially the entirety of the wearer's head by using two opposed, concentric shells of a flexible material. Such shells could be joined together at their perimeter to define and airtight chamber; and interior baffles could define separate compartments.

Also, it would be possible to replace certain inflatable members of the illustrated embodiment with members made of a cushioning material which is collapsible but not inflatable. For example, certain portions of a headpiece could include cushions made of a resilient foamed plastic material.

It is therefore intended that the scope of the invention only be defined by the appended claim.

I claim:

1. A protective headpiece comprising:

a skullcap means made of a thin collapsible sheet of resilient material and shaped to surround and conform to a human head and to cover all portions of the head except the facial region so that when the headpiece is worn the skullcap means receives and clings to the wearer's head and entirely supports the headpiece in place until it is pulled off by the wearer, a shell means made of collapsible cushioning material secured to the exterior surface of the skull cap means to provide protection from impacts to the head, said shell means comprising a plurality of inflatable flap members secured to the skullcap means, said flap members being shaped and positioned to provide gas filled cushions around a wearer's head, said cushions being shaped to form a pillow located to cover the crown of the wearer's head, toroidal tubes located to extend horizontally around the head at the forehead level, and at least one curved tube located to extend horizontally around the back of the neck, the headpiece being collapsible and foldable to occupy a minimal volume during storage;

a gas delivery tube connected with the interior of each flap member;

a self-contained source of pressurized gas connected to said tube;

means to release gas from the source to inflate the flap members; and a blow tube mechanism, including a one-way valve, connected to the gas delivery tube to provide backup means for inflating the flap members.

* * * * *